United States Patent [19]

van Baal

[11] 4,455,725

[45] Jun. 26, 1984

[54] METHOD AND APPARATUS FOR MAKING TUBULAR CONTAINERS, AT LEAST SUBSTANTIALLY CLOSED AT ONE END, FROM PIPE MATERIAL BY COLD-WORKING

[75] Inventor: Petrus H. van Baal, Amersfoort, Netherlands

[73] Assignee: Amcur N.V., Netherlands

[21] Appl. No.: 328,653

[22] Filed: Dec. 8, 1981

[30] Foreign Application Priority Data

Dec. 22, 1980 [NL] Netherlands ..... 8006992

[51] Int. Cl.³ ..... B21D 51/54

[52] U.S. Cl. ..... 29/1.3; 72/354; 72/356

[58] Field of Search ..... 72/357, 354, 356, 348, 72/349; 29/1.3, 1.31, 1.32

[56] References Cited

U.S. PATENT DOCUMENTS

| | | | |
|---|---|---|---|
| 2,079,102 | 5/1937 | Biginelli | 29/1.3 |
| 2,373,921 | 4/1945 | Snell | 29/1.3 |
| 2,755,839 | 7/1956 | Garrod et al. | 29/1.3 |
| 3,659,528 | 5/1972 | Scemtala | 29/1.3 |

*Primary Examiner*—Leon Gilden

*Attorney, Agent, or Firm*—Scully, Scott, Murphy & Presser

[57] ABSTRACT

A process and an apparatus for manufacturing tubular cartridges having one end at least substantially closed, by means of cold-working of tubular blanks, wherein a tubular blank is fed into a die snugly enclosing said blank, the tube end to be closed resting on a retractable bottom forming tool. With the tube so positioned a punch having an outer diameter larger than the inner diameter of the tube is lowered into the tube, which punch when moving through the tube displaces material from the entire length of the inner wall of the tube to the lower end of the tube so as to at least partially close this end of the tube.

10 Claims, 5 Drawing Figures

Figure 1:
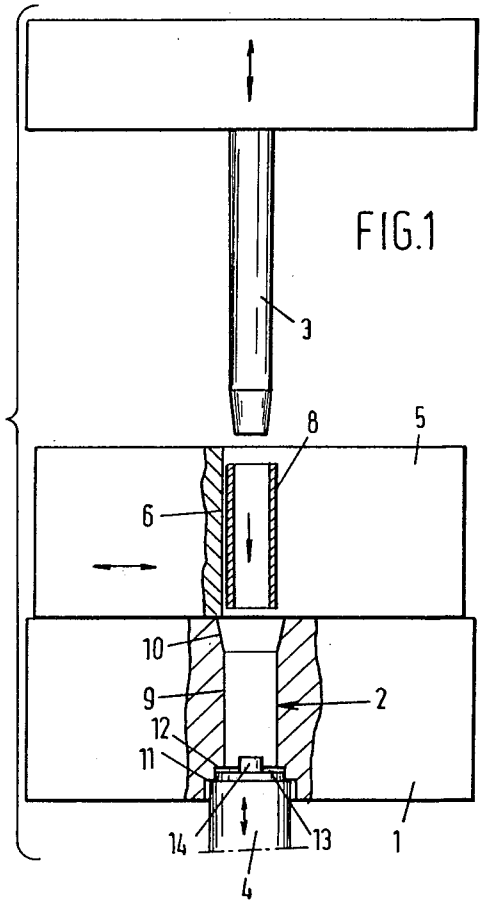

3
8
5
6
2
10
9
12
11
13
14
4
1

3
5
8
10
14
4
1

3
5
10
17
8
15
16
12
11
4
1

METHOD AND APPARATUS FOR MAKING TUBULAR CONTAINERS, AT LEAST SUBSTANTIALLY CLOSED AT ONE END, FROM PIPE MATERIAL BY COLD-WORKING

In particular in the case of tubular containers which in practice are used only once or at best a limited number of times, it is of importance that the cost price is minimized. If, however, the containers must satisfy severe standards as regards strength and dimensional accuracy, and in addition have a relatively complicated bottom configuration, this will, in hitherto known methods of manufacture, result in features having the effect of raising the cost price, such as a multi-phase manufacturing process and the use of relatively complicated dies.

An example of such containers are cartridge cases which, as is well-known, have a relatively thin cylindrical wall with a bottom at one end, while the cylindrical wall may have a constant wall thickness or one that decreases towards the open end, and the bottom having on the outside a cavity for accommodating a fuse which through an axial passage is connected to the interior of the case and, if designed for automatic or semi-automatic arms, an external annular groove is formed in the bottom zone for engagement by an ejector.

Traditionally, cartridge cases are made from a round platelet which by various stamping and deep-drawing operations is first deformed into a cup and subsequently adjusted to length in one or more stages. Apart from the relatively large number of necessary working phases, one drawback of this technique is that quite some waste is formed already in producing the round platelets.

From the literature, proposals are known, according to which the drawback last mentioned is met by starting not from a round platelet but from tubular material, for example, extruded brass piping.

Lengths of pipe are deformed at one end to form a bottom, and in subsequent working phases, the pipe can be given the required length and, if not yet done before, the bottom end is given the desired final configuration. Such techniques are described in German patent No. 893,936, Swiss patent No. 178,286, and in European patent application No. 0000438, as laid open to public inspection. All these prior proposals comprise forming a bottom at one pipe end by displacing exclusively material from that pipe end inwardly, and leaving the remaining part of the cylindrical wall of the pipe in tact. This part of the cylindrical wall is given the, reduced, final thickness in one or more subsequent working stages, in which the pipe is also given the required final length.

It is an object of the invention to provide a method which, as compared with prior proposals, is considerably simpler and hence less expensive, and in which, also, a simpler punch device can be used.

For this purpose, according to the invention, the starting product is a pipe which already has substantially the same length as the container to be manufactured, but has a greater wall thickness than the latter, and in which, while said pipe is laterally confined and supported at one end, material is removed from the inside of the cylindrical wall of the pipe and forced towards the supported end for forming a bottom at said supported end of the pipe by means of an interior forming tool driven axially through the pipe from the other end.

In principle, the method according to the invention only needs to comprise one operating phase for converting the tubular starting material into the desired final product, while at the same time virtually the entire pipe length is subjected to cold-working, and consequently its mechanical material properties are improved.

In a further elaboration of the invention, during the introduction of the interior forming tool into the pipe, pipe material is first retained at the end where the tool is introduced for axially anchoring that end of the pipe, and during the advanced movement of the tool the amount of pipe material retained is gradually reduced to 0 by moving along with the tool.

In this way, even when the wall thickness of the starting material is relatively small, the pipe is prevented from being axially crushed when the tool is slightly out of center when penetrating it.

For the performance of the method, the invention provides an apparatus characterized by a single die having a substantially cylindrical through hole for receiving successive pipe lengths, a punch movable entirely through said hole from one end thereof, said punch having a shape corresponding to the interior configuration of the containers to be formed, and a counter-punch for temporarily closing the opposite end of said hole, the end of said hole where the punch enters it having the shape of a funnel, the smallest transverse dimension of which defines the smallest outer diameter of the containers to be made.

Of a pipe located within the hole with a small amount of clearance, the end portion whence the punch enters the pipe is radially flared, which is permitted by the funnel-shape of the respective end of the die hole. The material present around the punch in the funnel-shaped opening forms an anchorage which prevents the pipe from being crushed in the zone ahead of the punch, and also a supply of material which during the continued punch movement is gradually used by being stripped by the sidewall of the punch.

Preferably, the shape of the counter-punch, that of the relevant part of the die hole, and that of the punch are adapted to the desired bottom configuration of the container to be made, and when the punch has approached the counter-punch to such an extent that the container bottom has the desired configuration, the counter-punch is withdrawn, and the punch with the container being formed around it moves through the die. As soon as the container formed is clear of the die holder it can be engaged by appropriate discharge means, and the punch can be withdrawn to its starting position.

For a reliable control of the punch stroke, the apparatus according to the invention may be provided with a block which can be periodically placed at the punch end of the die for temporarily limiting the punch stroke to a depth corresponding to the formation of the container bottom, which block is provided with a radial interruption permitting the lateral removal of the block, and also serving for permitting the passage of the punch and for supplying a next pipe length.

After the removal of the intermediate die, the punch movement can be continued in the manner described above for the ejection of a completed container.

One embodiment of the apparatus for manufacturing tubular containers formed at one end with a bottom by coldworking will be described, by way of example, with reference to the accompanying drawings, in which FIGS. 1-5 show successive operative positions of the punch device according to the invention in side-elevational view, partially in axial section.

As shown in the drawings, the apparatus comprises a die 1 with a die hole 2 and a punch 3 and a counter-punch 4, the latter being movable as indicated by the arrows.

The drawings further show an intermediate block 5 with an opening 6 and an ejector 7, both arranged to be laterally movable.

FIG. 1 shows the situation in which punch 3 is fully retracted, and intermediate block 5 is placed on top of die 1. Located in the hole 6 of the intermediate block is a pipe length 8, from which a cartridge case must be made in the apparatus shown.

The die hole 2 has a substantially cylindrical wall 9 extending throughout the major part of its depth. Its top end is formed as a funnel 10 and its bottom end is provided with a shoulder 11 which determines the top position of counter-punch 4, and a recess 12 for forming a flange in the vicinity of the bottom of the cartridge case to be made. Counter-punch 4 has a head face 13 and a central projection 14, respectively for forming the bottom face of the case to be made and for forming a recess therein for receiving an ignition charge. It is clear, however, that the elements 12-14, just described, are dependent on the desired configuration of the relevant part of the cartridge case to be made.

Figure 2:
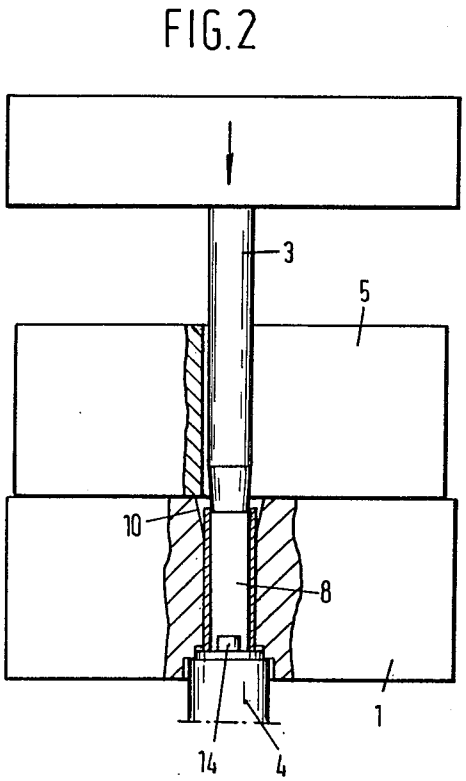

FIG. 2 shows the situation in which pipe length 8 is snugly received in hole 2. Positioning pipe 8 in this manner is facilitated by the presence of the funnel-shaped part 10 of hole 2. Punch 3 has been lowered into contact with the top end of pipe 8.

Figure 3:
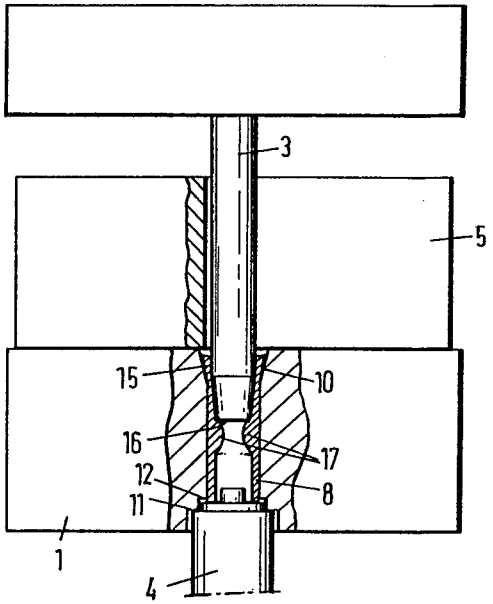

FIG. 3 shows the situation in which punch 3 has moved down slightly further, thereby flaring material 15 of the top end of pipe 8 laterally into the space present within funnel 10, while ahead of end face 16 of punch 3 material 17 from the inner wall of pipe 8 is forced into the direction of the bottom end of the pipe.

The laterally expanded material 15 at the upper end of the pipe forms an anchorage between punch 3 and the funnel wall 10, which anchorage prevents that, in particular with thin-walled pipes 8, the pipe material ahead of end face 16 begins to buckle rather than being forced ahead in front of end face 16 as indicated at 17.

During the further downward movement of punch 3, the amount of expanded material 15 will, however, constantly decrease owing to being carried along on the sidewall of punch 3, and be reduced to 0, at least substantially to 0.

Figure 4:
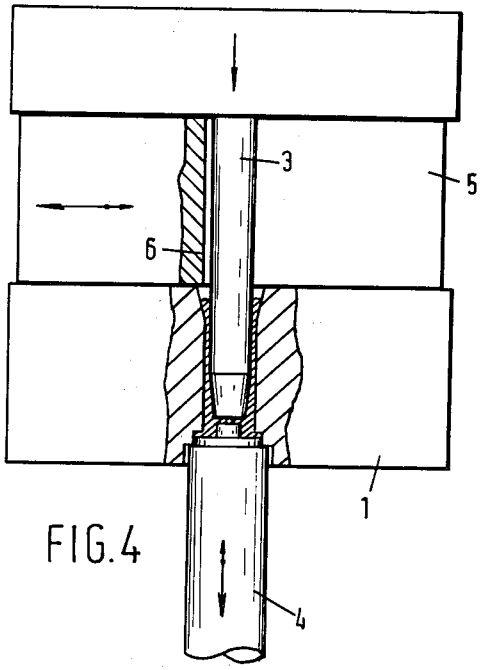

FIG. 4 shows the situation in which the bottom portion of the case to be made is completed, and the wall portion is substantially completed. The position of the punch is determined by intermediate block 5.

Figure 5:
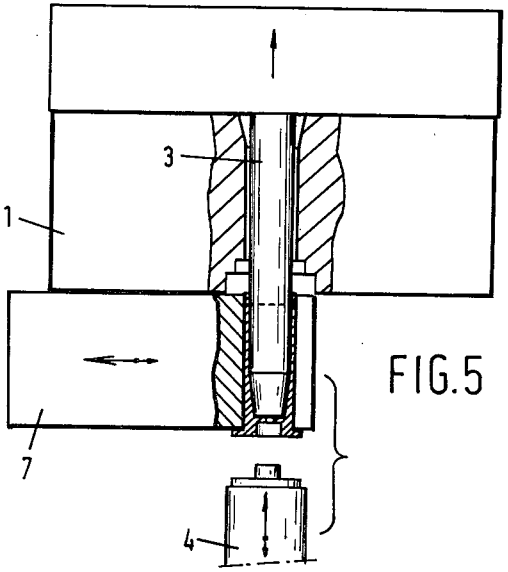

FIG. 5 shows the situation in which, after intermediate block 5 being laterally removed, punch 3 has been advanced further until the cartridge case formed is fully outside die 3 at the bottom end thereof, and can be engaged by ejector 7 which, after the punch being retracted to its starting position shown in FIG. 1, can laterally discharge the cartridge case.

At its upper end, the cartridge case thus made may have a slightly irregular edge configuration, which is removed in an after-treatment, which is necessary to ensure an accurate longitudinal dimension anyway (see the dotted line in FIG. 5).

As apparent from FIG. 4, during the formation of the bottom material from the inner wall of pipe 8 is forced downwardly. When the punch, the die hole and the pipe are properly dimensioned, it is possible to automatically leave an aperture in the center of the bottom to form a connection between the igniter cavity and the inner space of the case. Preferably, in connection with the required reliability in operation in the case of cartridge cases, this opening is finish-drilled afterwards.

The method and apparatus according to the present invention are distinguished from prior techniques in simplicity and hence low cost price and yet high reliability in operation, while the end product has a high dimensional accuracy and a great strength.

I claim:

1. Apparatus for making tubular containers having a substantially closed end from pipe blanks by cold working, said apparatus comprising:

(a) a single die having a substantially cylindrical through hole for receiving successive pipe lengths, (b) a punch movable entirely through said hole from one end thereof, said punch displacing material from the inner walls of the pipe blank and having a shape corresponding to the interior configuration of the containers to be formed, and (c) a counter-punch for temporarily closing the opposite end of said hole with material displaced from the inner wall of the pipe, said die through hole having a first end where the punch enters it which defines the shape of a funnel, the smallest transverse dimension of which defines the outer diameter of the containers to be made.

2. Apparatus as claimed in claim 1, which further comprises a reciprocating block which can be periodically placed at the first end of the die for temporarily limiting the punch stroke to a depth corresponding to the formation of the container bottom, said block being provided with a radial opening permitting the lateral removal of the block, and also serving for permitting the passage of the punch and for supplying a next pipe blank to be formed.

3. A method of making tubular containers at least substantially closed at one end from pipe material by cold working, said method comprising:

(a) confining a pipe blank about its outer cylindrical surface;

(b) axially anchoring the pipe blank to prevent movement of the blank along its cylindrical axis;

(c) cold working the interior walls of the blank with an interior forming tool to displace material from the inner wall of the blank to subsequently close the pipe;

(d) forming a substantially closed end for the container with said material displaced from the inner walls of the pipe.

4. A method of making tubular containers as claimed in claim 3 which further includes the step of supporting the pipe blank from a first end while introducing said interior forming tool through said first end.

5. A method of making tubular containers as claimed in claim 4 wherein the first end of said pipe blank is gradually reduced to zero as the interior forming tool displaces material to the closed end of the container.

6. A method of making tubular containers as claimed in claim 2 wherein the base is formed between the interior forming tool and a reciprocating counter punch.

7. A method of making tubular containers as claimed in claim 6 wherein the container is confined with a single die having a finished outer dimension and configuration defined therein.

8. A method of making tubular containers as claimed in claim 7 wherein the container is subsequently removed from the die by first withdrawing the counter punch and subsequently extending the length of travel of said interior forming tool.

9. A method of making tubular containers as claimed in claim 7 which further comprises the step of limiting the axial movement of the interior forming tool to form a container bottom of predetermined thickness.

10. A method of making tubular containers as claimed in claim 3 wherein the anchoring, cold-working and forming steps are performed with a single stroke of the interior forming tool.

* * * * *

UNITED STATES PATENT OFFICE

CERTIFICATE OF CORRECTION

Patent No. 4,455,725 Dated June 26, 1984

Inventor(s) Petrus H. van Baal

It is certified that error appears in the above-identified patent and that said Letters Patent are hereby corrected as shown below:

Title page, Assignee reads: "Amcur N.V., Netherlands" but should read --Amcur N.V., Curacao, Netherlands Antilles--.

Signed and Sealed this

*Twenty-third* Day of *July 1985*

[SEAL]

*Attest:*

DONALD J. QUIGG

*Attesting Officer* *Acting Commissioner of Patents and Trademarks*